United States Patent [19]

Grosshauser

[11] Patent Number: 5,010,817

[45] Date of Patent: Apr. 30, 1991

[54] METHOD AND APPARATUS FOR FLEXOGRAPHIC PRINTING

[75] Inventor: Heinrich Konrad Grosshauser, Würzburg, Fed. Rep. of Germany

[73] Assignee: Koenig & Bauer Aktiengesellschaft, Würzburg, Fed. Rep. of Germany

[21] Appl. No.: 339,692

[22] Filed: Apr. 18, 1989

[30] Foreign Application Priority Data

Apr. 26, 1988 [DE] Fed. Rep. of Germany ..... 3814049

[51] Int. Cl.[5] ..... B41F 31/04; B41F 31/06; B41F 31/08; B41L 27/10

[52] U.S. Cl. ..... 101/350; 101/366

[58] Field of Search ..... 101/350, 363, 366, 148, 101/365, 364, 487, 207, 208–210, 157, 169; 118/261

[56] References Cited

U.S. PATENT DOCUMENTS

| | | | |
|---|---|---|---|
| 2,260,364 | 10/1941 | Case | 101/350 X |
| 2,396,946 | 3/1946 | Grupe | 101/170 X |
| 4,152,986 | 5/1979 | Dadowski et al. | 101/350 X |
| 4,362,179 | 12/1982 | MacPhee et al. | 101/364 X |
| 4,497,250 | 2/1985 | Dressler | 101/366 |
| 4,559,871 | 12/1985 | Kutzner et al. | 101/207 |
| 4,753,165 | 6/1988 | Grosshauser | 101/350 |
| 4,879,951 | 11/1989 | Yoshida et al. | 101/366 |

*Primary Examiner*—J. Reed Fisher

*Attorney, Agent, or Firm*—Jones, Tullar & Cooper

[57] ABSTRACT

Flexographic printing in a web-fed rotary printing press is accomplished using water-based inks without plugging the screened surfaces of the printing plate. The temperature of the water-based ink is kept within a first temperature range while the temperature of the screened ink roller is kept within a second, higher temperature range.

2 Claims, 1 Drawing Sheet

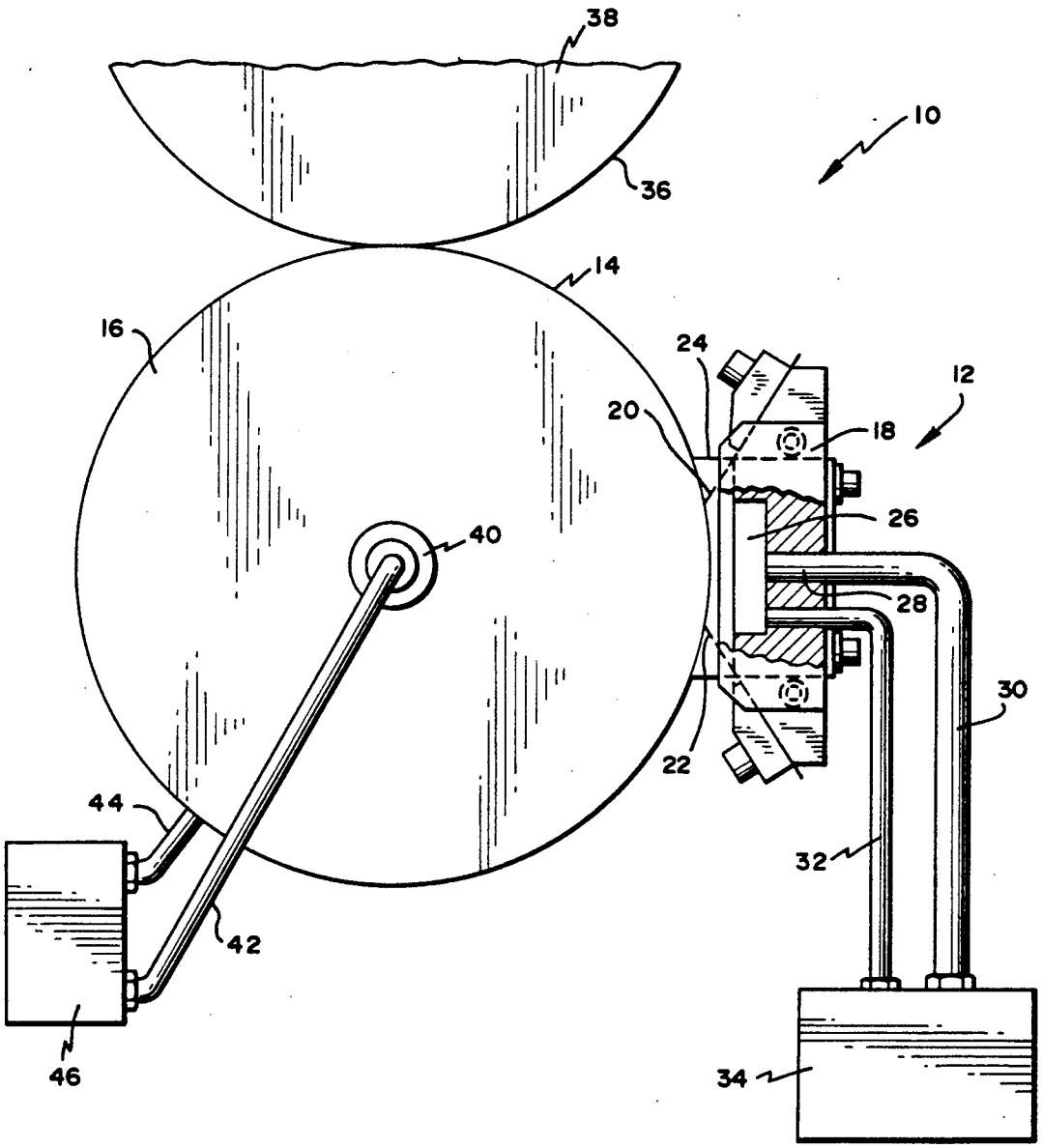
38
10
36
14
16
24
12
20
18
26
40
28
30
22
44
32
42
46
34

METHOD AND APPARATUS FOR FLEXOGRAPHIC PRINTING

FIELD OF THE INVENTION

The present invention is directed generally to a method and apparatus for flexographic printing. More particularly, the present invention is directed to a method and apparatus for flexographic printing using a plastic printing plate. Most specifically, the present invention is directed to a method and apparatus for flexographic printing which avoids ink plugging of screened printing plates. The flexographic water-based inks used in the flexographic printing process are applied from an ink fountain to a screened surface ink roller. The ink in the ink fountain is circulated through a temperature control device to maintain this ink at a first temperature. The surface of the screened surface ink roller is maintained at a second, higher temperature. This avoids the filling in of the screened surfaces of the plastic printing plates.

DESCRIPTION OF THE PRIOR ART

The flexographic printing process is generally well known in the art. In this process, so-called flexographic water-based inks are applied to paper printing mediums, typically to produce printed periodicals. In a typically flexographic printing process, the water-based ink is applied to the surface of a screened ink roller through an ink fountain or reservoir which uses doctor blades and end plates, in combination with the screened ink roller, to form a reservoir for the ink. This water-based ink is carried by the pockets or recesses in the screened ink roller and is applied to a plastic printing plate, such as a photopolymer printing plate. Assemblies of this general type may be seen in German published unexamined patent applications Nos. 3,135,711 and 3,320,638, this latter application corresponding to U.S. Pat. No. 4,559,871 which is assigned to the assignee of the present application. The surface of the photopolymer or similar printing plate which will accomplish the flexographic printing is also screened.

There are numerous, generally well known advantages provided by flexographic water-based inks, which consist primarily of ink pigments, various additives, and water. However, one limitation of this type of printing is a so-called "plugging" or partial filling in of the screened surface of the printing plate. This plugging or filling in of portions of the pockets or recesses in the screened surface of the printing plate will clearly have an undesirable effect on printing quality by creating disturbances in the printed images produced by the printing plate. It will be apparent that the danger of filling in parts of the printing plate increases with increasing fineness of the screen and the larger the surface portion of the screen is dots per surface unit.

SUMMARY OF THE INVENTION

It is an object of the present invention to provide a method and apparatus for flexographic printing.

Another object of the present invention is to provide a method and apparatus for flexographic printing using a screened printing plate.

A further object of the present invention is to provide a method and apparatus for flexographic printing which avoids plugging of the screened printing plate.

Yet another object of the present invention is to provide a method and apparatus for flexographic printing which utilizes temperature controls of the printing ink.

Still a further object of the present invention is to provide a method and apparatus for flexographic printing which avoids filling in of the screened surface of plastic printing plates that are inked by water-based inks.

As will be discussed in detail in the description of the preferred embodiment, which is set forth subsequently, the method and apparatus for flexographic printing in accordance with the present invention utilizes a screened ink roller with a flush inking unit to supply water-based printing inks to a screened surface plastic printing plate. The water-based ink in the inking unit is continually circulated through an ink feeding and temperature control assembly which maintains the ink within a first temperature range. The screened surface ink roller's surface is maintained at a second, higher temperature. This utilization of these controlled temperatures significantly reduces the ink plugging or partial filling in of the screened surface of the plastic printing plate.

The method and apparatus for flexographic printing in accordance with the present invention, as indicated above, significantly reduces the problems of ink plugging or partial filling in of the screen surface of the plastic printing plate. The primary advantage which is achieved by this invention thus is that a web-fed rotary printing machine which uses flexographic or water-based inks does not need to be periodically shut down to have the cells of the screened surface of the printing plate cleaned. This increases printing efficiency and reduces press downtime and upkeep expenses.

BRIEF DESCRIPTION OF THE DRAWINGS

While the novel features of the method and apparatus for flexographic printing are set forth with specificity in the appended claims, a full and complete understanding of the invention may be had by referring to the detailed description of the preferred embodiment, which is presented subsequently, and as is illustrated in the accompanying sole drawing figure in which there is shown a schematic side elevation view of a flexographic printing arrangement in accordance with the present invention.

DESCRIPTION OF THE PREFERRED EMBODIMENT

Referring to the sole drawing figure, there may be seen, generally at 10, a portion of a web-fed rotary printing machine for applying the flexographic printing process to a print receiving medium, such as paper, to print periodicals, such as newspapers. An inking unit is shown generally at 12 and is generally a so-called flush inking unit, as described in the previously referenced German published unexamined patent applications Nos. 3,135,711 and 3,320638. This inking unit 12 supplies ink to a screened surface 14 of a generally well known screened ink roller 16. This ink roller is mounted for rotation between spaced side frames (not shown).

Each inking unit 12 includes one or more inking bars 18 that can be moved into or out of contact with the surface 14 of screened ink roller 16. Each inking bar 18 carries an upper doctor blade 20 and a lower doctor or stripping blade 22. These upper and lower blades 20 and 22, together with spaced end plates 24 define an ink receiving recess 26. When the inking bar 18 is brought into position adjacent the screened ink roller 16, the recess 26 will be provided with ink through a bore 28 and suitable supply and return conduits 30 and 32 which are in fluid communication with an ink feeding device 34. Ink supplied to the screened surface 14 of the screened ink roller 16 from the ink recess 24 is used to ink a printing plate 36 on the surface of a plate cylinder 38. This printing plate 36 is preferably made of a plastic, such as a photopolymer and has a screened surface.

Ink feeding device, generally at 34, is of generally conventional structure and feeds temperature controlled ink to the recess 26 of the inking bar 18 through supply conduit 30 and bore 28. In accordance with the present invention, this ink is kept at a temperature between generally about 9 and 14 degrees Celsius. This water-based ink is continuously supplied to recess 28 in inking unit 12 through supply conduit 30 and surplus water-based ink is continuously taken away from inking unit 12 through return conduit 32 which returns it to the ink feeding and temperature control device 34. There the temperature of the water-based ink is constantly maintained in this 9 to 14 degree Celsius range.

The screened ink roller 16 is hollow and connected by rotary unions 40 to a water feed line 42 and to a water return line 44. These water feed and return lines are connected to a suitable device 46 to supply and control the temperature of water which passes through the screened ink roller 16. The water circulation is adjusted in such a way that the surface temperature of the screened ink roller 16 is maintained between 18 and 22 degrees Celsius. This method of maintaining the ink in the recess 26 in a first temperature range, and of maintaining the surface temperature of the screened ink roller in a second, higher temperature range has been found to significantly reduce plugging or filling in of the screened surface of the plastic printing plates 36 carried on the plate cylinder 38.

While a preferred embodiment of a method and apparatus for flexographic printing in accordance with the present invention has been set forth fully and completely hereinabove, it will be apparent to one of skill in the art that a number of changes in, for example, the overall size of the ink roller, the number of inking units, the number of printing plates and the like may be made without departing from the true sprit and scope of the present invention which is accordingly to be limited only by the following claims.

What is claimed is

1. A method for preventing plugging of screened surfaces of a printing plate which is inked-in by water-based printing inks in a web-fed rotary printing machine which prints a printed medium, said method comprising:

providing an inking unit;

providing a printing plate having screened surfaces;

supplying a water-based printing ink continuously to said inking unit;

contacting said printing ink in said inking unit with a screened ink roller;

removing unused water-based printing ink continuously from said inking unit;

maintaining the temperature of said water-based ink in said inking unit within a first temperature range between 9 and 14 degrees Celsius;

supplying said water-based printing ink from said screened ink roller to said printing plate; and maintaining a surface portion of said screened ink roller which supplies said water-based ink to said printing plate within a second, higher temperature range between 18 and 22 degrees Celsius.

2. An apparatus for preventing plugging of screened surfaces of a printing plate which is inked-in by water-based printing inks in a web-fed rotary printing machine which prints a printed medium, said apparatus comprising:

an ink fountain having an ink reservoir with a water based printing ink;

a screened surface ink roller which receives water-based ink from said ink fountain;

a screened surface printing plate which receives said water-based ink from said screened surface ink roller;

means supplying said water-based printing ink from said screened ink roller to said printing plate;

means to continuously supply said ink to, and remove said ink from said ink reservoir;

means to maintain said ink in said ink reservoir within a first temperature range of between 9 and 14 degrees Celsius; and means to maintain a surface portion of said screened ink roller within a second, higher temperature range of between 18 and 22 degrees Celsius.

* * * * *